US008094851B2

(12) United States Patent
Heerlein et al.

(10) Patent No.: US 8,094,851 B2
(45) Date of Patent: Jan. 10, 2012

(54) HEARING APPARATUS HAVING A ROCKER-LIKE ACTUATOR FOR SWITCHING ON/OFF

(75) Inventors: Markus Heerlein, Singapore (SG); Thomas Kasztelan, Erlangen (DE); Wee Haw Koo, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 1265 days.

(21) Appl. No.: 11/805,820

(22) Filed: May 24, 2007

(65) Prior Publication Data

US 2007/0286444 A1 Dec. 13, 2007

(30) Foreign Application Priority Data

May 24, 2006 (DE) ..... 10 2006 024 412

(51) Int. Cl.
*H04R 25/00* (2006.01)

(52) U.S. Cl. ..... 381/324; 381/312

(58) Field of Classification Search ..... 381/312, 381/322, 324; 200/16 R, 52 R, 275, 279, 200/561, 562, 553
See application file for complete search history.

(56) References Cited

U.S. PATENT DOCUMENTS

| | | | |
|---|---|---|---|
| 2001/0040973 | A1 | 11/2001 | Fritz et al. |
| 2003/0155218 | A1 | 8/2003 | Panagl |
| 2004/0163940 | A1 | 8/2004 | Ravnkilde et al. |

FOREIGN PATENT DOCUMENTS

| | | | |
|---|---|---|---|
| DE | 3913789 | A1 | 10/1990 |
| EP | 1 463 376 | A2 | 4/2004 |

*Primary Examiner* — Tuan Nguyen

(57) ABSTRACT

The size of hearing apparatuses and in particular of hearing devices is to be reduced. To this end, provision is made to combine a rocker-like actuator of the hearing apparatus for manually adjusting a parameter of a signal processing unit for pressing from a neutral position in a first adjusting position or a second adjusting position with an on/off switch. To this end, the rocker-like actuator can be pressed into an additional switching position. The multiple functionalities of the actuator allow installation space to be conserved and thus allow the housing of the hearing apparatus to be simplified and minimized.

18 Claims, 1 Drawing Sheet

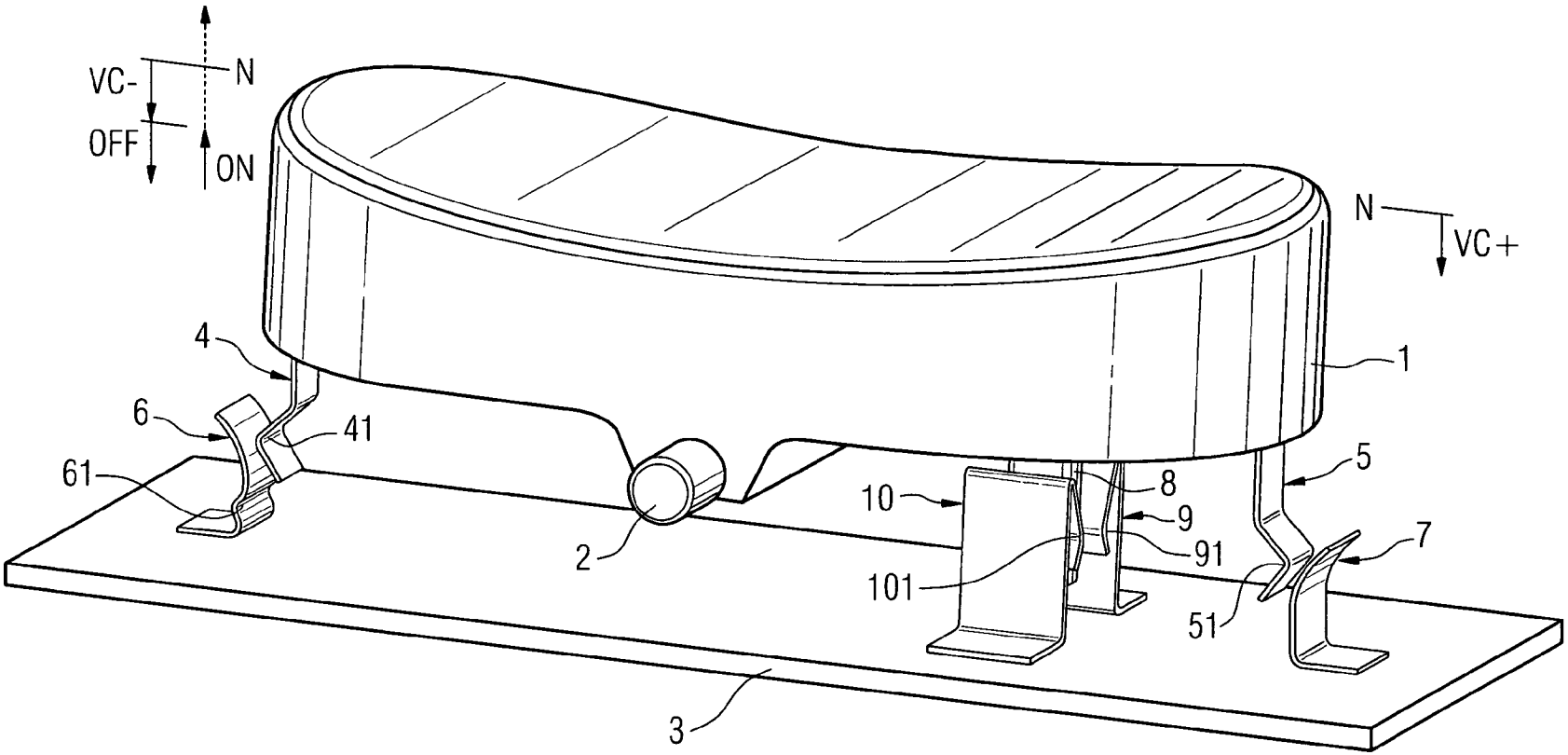
VC+
N
1
5
7
51
91
9
8
101
10
3
2
41
4
6
61
N
ON
VC-
OFF

HEARING APPARATUS HAVING A ROCKER-LIKE ACTUATOR FOR SWITCHING ON/OFF

CROSS REFERENCE TO RELATED APPLICATIONS

This application claims priority of German application No. 10 2006 024 412.5 filed May 24, 2006, which is incorporated by reference herein in its entirety.

FIELD OF THE INVENTION

The present invention relates to a hearing apparatus having a rocker-like actuator for switching on/off. Hearing devices are known here in particular as hearing apparatuses. Other hearing apparatuses such as headsets, earphones and suchlike can however also benefit from the invention.

BACKGROUND OF THE INVENTION

Hearing devices generally have a switch, with which they can be switched on and off. To this end, a push-button switch or a toggle switch is typically used for manual activation.

In many cases, a volume control is also provided on hearing devices, with which the amplification of the hearing device can be adjusted. An adjusting wheel is for the most part selected here to continually modify the amplification or an impulse sensor is selected to gradually raise and lower the amplification.

A generic hearing device is known from the publication EP 1 463 376 A2. The hearing device comprises a control element having a mechanical control section as well as an electrical switching element. The switching element has at least one push button which reacts to pressure. Furthermore, the control element is arranged in an elastically or springy moveable or tiltable manner in respect of the push button. The control element is preferably used to control the volume or to change over the program.

With each hearing device, the problem essentially consists in that the installation space is significantly restricted. Very little space is thus also available on the hearing device surface, upon which switches and actuators can be arranged. As many switches and controllers as possible are thus dispensed with or the switches are mounted on remote controllers for instance. It is however still advantageous to have certain adjusting and switching possibilities directly on the hearing device.

SUMMARY OF THE INVENTION

The object of the present invention thus consists in providing as compact a switch and/or actuator as possible for a hearing apparatus.

This object is achieved according to the invention by a hearing apparatus having an on/off switch for switching the hearing apparatus on/off and a rocker-like actuator for manually adjusting a parameter of a signal processing unit in the hearing apparatus by pushing from a neutral position into a first adjusting position or a second adjusting position, with the on/off switch being integrated in the rocker-like actuator in terms of design and the rocker-like actuator being able to be pushed into an additional switching position for switching on/off.

A dual functionality is realized in an advantageous manner by means of the rocker-like actuator. This can be achieved in that it is not only possible to push into two positions but instead at least into a third position.

The positions of the actuator in a direction of rotation are preferably arranged as follows: Switching position for OFF, first adjusting position, neutral position and second adjusting position. This means that the hearing apparatus, in particular the hearing device, can be switched off by over-compressing the first adjusting position.

The adjusting and switching positions mentioned above can herewith be realized such that a first contact element, a second contact element and a third contact element are fastened to the rocker of the actuator. Furthermore, a first counter contact element, a second counter contact element and a third counter contact element are arranged on a base of the actuator, upon which the rocker is mounted in a rotationally moveable fashion. The first contact element is then in contact with the first counter contact element in the switching position OFF and in the first adjusting position, the third contact element is in contact with the third counter contact element in the neutral position and the second contact element is in contact with the second counter contact element in the second adjusting position. A conventional rocker switch is thus only to be additionally equipped with a further contact pair.

The first counter contact element can comprise a locking section, which locks with the locking section of the first contact element in the switching position OFF. In this way, the rocker switch apparatus according to the invention can be brought into a stable OFF position.

The third counter contact element can likewise comprise a locking section, which locks in the neutral position with a locking section of the third contact element. By means of this measure, the rocker is able to be maintained in a stable neutral position, so that the volume for instance, if the actuator is used here, is not unintentionally adjusted.

Furthermore, the hearing apparatus according to the invention can comprise a timer facility, with which a start of the evaluation of the actuator can be predetermined after a switch-on. This is particularly necessary if a contact pair exhibits not only an electrical functionality but also a mechanical functionality. The electrical contact is then only to be evaluated for instance if the contact pair is pushed out of a locking position.

An alternative embodiment can thus consist in the additional switching position for switching off the hearing apparatus being achieved by over-compressing the first adjusting position and another switching position for switching on being achieved by over-compressing the second adjusting position. Besides the neutral position, four further positions for switching and adjusting the rocker are thus assigned to said rocker.

BRIEF DESCRIPTION OF THE DRAWINGS

The present invention is now described in more detail with reference to the appended drawing, which shows a perspective view of an inventive, rocker-like actuator having multiple functionalities.

DETAILED DESCRIPTION OF THE INVENTION

The embodiments illustrated in further detail below represent preferred exemplary embodiments of the present invention The rocker 1 shown in the FIG is mounted to a spindle 2 in a rotatable fashion. The rocker 1 is herewith able to carry out rocker movements opposite to a base or printed circuit board 3. A first contact element 4 is located on one end of the rocker and a second contact element 5 is arranged on the opposite end of the rocker 1. On the printed circuit board 3, a first counter contact element 6 is assigned to the first contact element 4 and a second counter contact element 7 is assigned to the second contact element 5 of the rocker 1. All contact elements are made out of metal tapes and each have a specific bending shape. The free end of the contact elements 4, 5 of the rocker 1 has an L-shaped design in each instance, and is all in all bent outwards a little, i.e. away from the spindle 2. A tip 41 pointing outwards is herewith produced for the contact element 4 and a tip 51 pointing outwards likewise results for the second contact element 5.

The two counter contact elements 6 and 7 essentially protrude vertically upwards from the printed circuit board 3 to the respective contact elements 4, 5. The free ends of the two counter contact elements 6, 7 are bent outwards, i.e. away from the spindle 2. When pushing down on the left side of the rocker 1 in the FIG, the first contact element 4 thus comes into contact with the bent free end of the first contact element 6 with its tip 41 or its outermost free end. In a similar manner, the second contact element 5 comes into contact with the bent free end of the second counter contact element 7 with its tip 51 or its outermost free end when pushing down on the right side of the rocker 1. The volume can thus be reduced for instance by pushing down on the left side of the rocker 1, as is illustrated in the FIG by the arrow VC− (Volume control).

In the section between the bent end and the other end fastened to the printed circuit board 3, the first counter contact element 6 has a groove 61, which can interact with the tip 41 of the first contact element 4 of the rocker 1. If the left side of the rocker 1 is namely pushed down further after touching the first contact element 4 with the first counter contact element 6, the tip 41 locks in the groove 61. This is shown in the FIG with the arrow OFF. In this position, with the rocker 1 tilted far to the left, a contact pair is opened to switch the hearing apparatus on/off. This contact pair consists of a third contact element 8, which is arranged on the underside of the rocker 1 on the same rocker side as the second contact element 5. Two third counter contact elements 9, 10 are assigned to this third contact element 8 on the printed circuit board side. Both counter contact elements 9, 10 face one another in an axial direction of the spindle 2 and have a springy L-shaped end with a tip 91 and 101 in each instance on their opposing sides.

The third contact and counter contact elements 8, 9 are used to switch the hearing apparatus on/off. In the neutral position of the rocker 1, shown in the FIG, the third counter contact elements 9, 10 come into contact with the third contact element 8. Accordingly, the hearing apparatus is switched on. If by contrast the rocker 1 is over-compressed out of the VC− position into the OFF position, so that the tip 41 locks into the groove 61, the third contact element 8 is released from the two third counter contact elements 9 and 10 so that the hearing apparatus is switched off.

If the right side of the rocker 1 in the OFF position is pressed down, the tip 41 is released from the groove 61 and the third contact element 8 comes into contact with the two third counter contact elements 9, 10, so that the hearing apparatus is switched on according to the arrow ON.

By further tilting the rocker 1 in the clockwise direction, the contact remains between the third contact element 8 and the two third counter contact elements 9 and 10. By rotating the rocker 1, after activation, about a specific angle in the clockwise direction, the first contact element 4 leaves the first counter contact element 6, so that the volume is no longer reduced (VC−). The rocker 1 is then in a neutral position N, in which the second contact element 5 is also not in contact with the second counter contact element 7, but the contact furthermore exists between the third contact element 8 and the third counter contact elements 9, 10. To retain the rocker in a stable manner in this neutral position N, the third contact element 8 likewise has one or a number of grooves (not shown), into which the grooves 91 and 101 of the counter contact elements 9, 10 lock. If the rocker 1 is tilted out of the neutral position N, the free ends of the counter contact elements 9 and 10 thus bend.

If the rocker 1 is pushed out of the neutral position N downwards to the right, so that it rotates further in the clockwise direction, the contact remains between the third contact element 8 and the two counter contact elements 9 and 10. In addition, the second contact element 5 also now touches the second counter contact element 7, so that the volume of the hearing apparatus is increased, in accordance with the arrow VC+. The locking mechanism of the third contact and/or counter contact elements 8, 9, 10 pulls the rocker 1 back into the neutral position.

Separate springs can also be provided on the rocker 1, which hold the rocker 1 in the neutral position, instead of the locking mechanism of the third contact and/or counter contact elements 8, 9, 10.

A further embodiment of the present invention thus consists in the rocker coming into contact with the printed circuit board 3 when over-compressing the VC position with its first contact element 4, as a result of which a switch-off impulse is released. On the other hand, the printed circuit board 3 has a contact, where the second contact element 5 comes into contact with the printed circuit board 3 when pushing down on the right side of the rocker. During this contact, a switch on impulse can be triggered.

An additional functionality of the rocker can herewith be achieved in that it is part of a so-called "flap cover", i.e. a cover for a programming socket in the hearing apparatus or the flap cover itself. The surface, which has to be made available for the programming socket, can herewith be simultaneously used for the switching and actuating functions.

By reducing the switches and/or actuators on the housing surface, the hearing apparatus and/or the hearing device can be better protected against splash water. Furthermore, a reduction in the switches results in a simplified design of the housing and in a more ergonomic operation, in addition to sparing a separate button. Not least, smaller hearing apparatuses and hearing devices can be designed by means of the multiple functionalities of the actuator according to the invention.

The invention claimed is:

1. A hearing apparatus, comprising:

an on/off switch for switching the hearing apparatus on and off; and an actuator comprising a rocker which is mounted on a spindle and is capable of carrying out rocker like movements about the spindle, such that the rocker is movable into at least four positions, wherein the actuator configured for manually adjusting a parameter of the hearing apparatus by pressing the rocker from a neutral position to either a first adjustment position or a second adjustment position, wherein the on-off switch is integrated into the actuator such that the rocker can be pressed into an additional switching position for switching the hearing apparatus on or off.

2. The hearing apparatus as claimed in claim 1, further comprising a first contact element fastened to one end of the rocker and a second contact element and a third contact element fastened to another end of the rocker.

3. The hearing apparatus as claimed in claim 2, further comprising a first counter contact element, a second counter contact element, and a third counter contact element arranged on a base of the actuator.

4. The hearing apparatus as claimed in claim 3, wherein the first contact element contacts the first counter contact element in the first adjustment position.

5. The hearing apparatus as claimed in claim 4, wherein the hearing apparatus is switched off by over-compressing the first adjustment position to a switching off position.

6. The hearing apparatus as claimed in claim 5, wherein the switching off position is locked by locking a first locking section of the first contact element into a further first locking section of the first counter contact element.

7. The hearing apparatus as claimed in claim 6, wherein the third contact element is released from the third counter contact element in the switching off position so that the hearing apparatus is switched off.

8. The hearing apparatus as claimed in claim 3, wherein the third contact element contacts the third counter contact element in the neutral position so that the hearing apparatus is switched on.

9. The hearing apparatus as claimed in claim 8, wherein the neutral position is locked by locking a third locking section of the third contact element into a further third locking section of the third counter contact element.

10. The hearing apparatus as claimed in claim 3, wherein the second contact element contacts the second counter contact element in the second adjustment position.

11. The hearing apparatus as claimed in claim 10, wherein the hearing apparatus is switched on by over-compressing the second adjustment position.

12. The hearing apparatus as claimed in claim 1, wherein the actuator is simultaneously used as a cover or a part of a cover for a programming socket of the hearing apparatus.

13. The hearing apparatus as claimed in claim 1, wherein the at least four positions of the actuator being arranged in a direction of rotation of the spindle are as follows: switching position for OFF, first adjustment position, neutral position and second adjustment position.

14. A method for controlling a hearing apparatus, comprising:

integrating an on/off switch of the hearing apparatus into an actuator of the hearing apparatus, the actuator comprising a rocker which is mounted on a spindle and is capable of carrying out rocker like movements about the spindle such that the rocker is movable into at least four positions, controlling the hearing apparatus by adjusting a parameter of the hearing apparatus by pressing the rocker from a neutral position to either a first adjustment position or a second adjustment position, and switching the hearing apparatus on or off by pressing the rocker in to an additional switching position.

15. The method as claimed in claim 14, wherein the adjustment position comprises a first adjustment position and a second adjustment position.

16. The method as claimed in claim 15, wherein the hearing apparatus is switched off by over-compressing the first adjustment position.

17. The method as claimed in claim 15, wherein the hearing apparatus is switched on by over-compressing the second adjustment position.

18. The method as claimed in claim 14, wherein the actuator is simultaneously used as a cover or a part of a cover for a programming socket of the hearing apparatus.

* * * * *